United States Patent [19]

Valev

[11] Patent Number: 4,480,608

[45] Date of Patent: Nov. 6, 1984

[54] RECIPROCATING INTERNAL COMBUSTION ENGINE AND SUPPORT ASSEMBLY

[75] Inventor: Assen Valev, Steyr, Austria

[73] Assignee: Steyr-Daimler-Puch Aktiengesellschaft, Vienna, Austria

[21] Appl. No.: 359,279

[22] Filed: Mar. 18, 1982

[30] Foreign Application Priority Data

Mar. 31, 1981 [AT] Austria ..... 1487/81

[51] Int. Cl.[3] ..... F02B 77/00

[52] U.S. Cl. ..... 123/195 C; 123/195 S; 123/198 E; 181/204; 277/235 B

[58] Field of Search ..... 123/198 E, 195 S, 195 C, 123/195 A; 181/204; 277/235 B

[56] References Cited

U.S. PATENT DOCUMENTS

| | | | |
|---|---|---|---|
| 3,263,663 | 8/1966 | Connell | 123/195 R |
| 3,863,936 | 2/1975 | Farnam et al. | 277/235 B |
| 4,048,366 | 9/1977 | Kingsbury | 181/204 |
| 4,137,888 | 2/1979 | Allan | 181/204 |
| 4,203,407 | 5/1980 | Fachbach et al. | 181/204 |
| 4,342,289 | 8/1982 | Komp | 123/195 A |

FOREIGN PATENT DOCUMENTS

| | | |
|---|---|---|
| 308475 | 10/1972 | Austria . |
| 1775468 | 6/1974 | Fed. Rep. of Germany . |
| 2612182 | 10/1976 | Fed. Rep. of Germany . |
| 2801431 | 1/1980 | Fed. Rep. of Germany . |

*Primary Examiner*—Craig R. Feinberg
*Assistant Examiner*—David A. Okonsky
*Attorney, Agent, or Firm*—Kurt Kelman

[57] ABSTRACT

An engine block includes a crankshaft, and is enclosed by a sheath. Sealing elements connect the sheath to the engine block and insulate against structure-borne sound. A flywheel is non-rotatably connected to the crankshaft at one end of the engine block. A power train housing is disposed at that end of the engine block and includes a flywheel housing which accommodates the flywheel. The flywheel housing is rigid with the engine block and forms a unit therewith. The sheath encloses the engine block on all sides and defines an oil chamber around the engine block. The sealing elements consist of rings provided at opposite ends of the engine block. The unit is carried by and connected to a support by elastic elements which insulate against structure-borne sound.

5 Claims, 5 Drawing Figures

Figure 1:
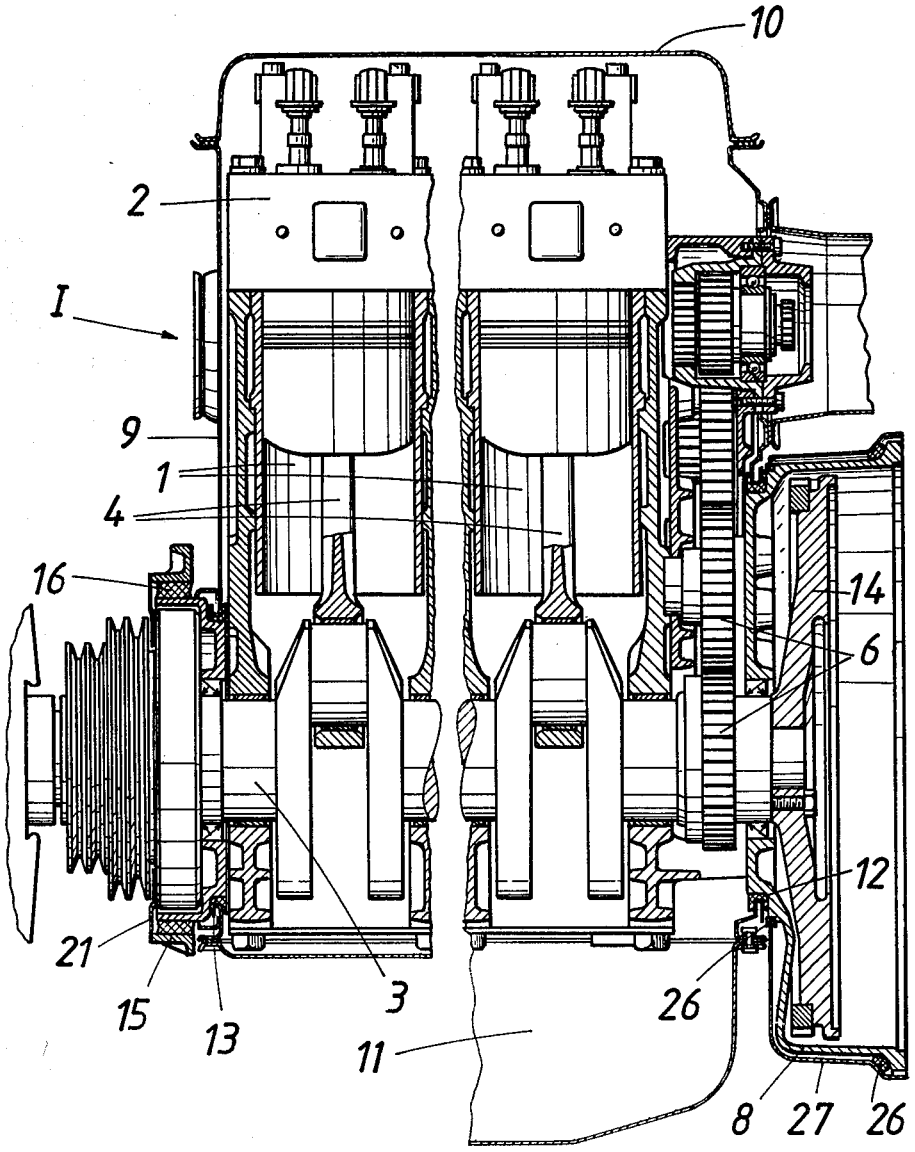

FIG. 4
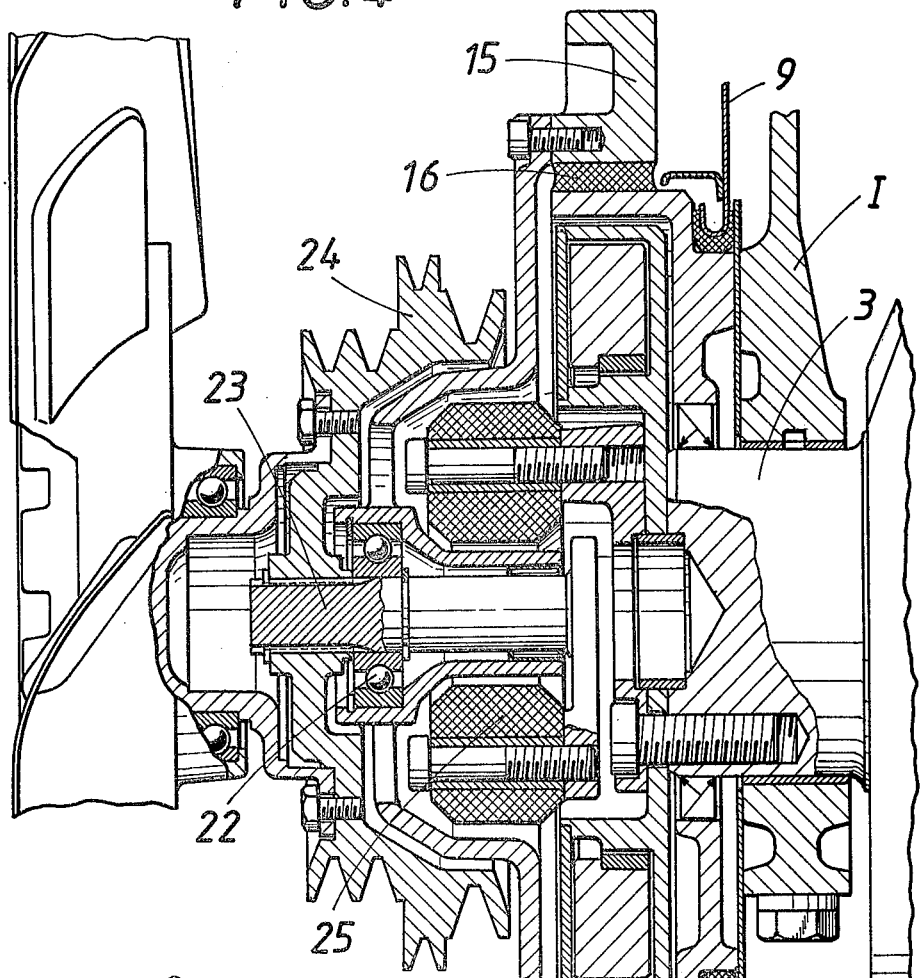
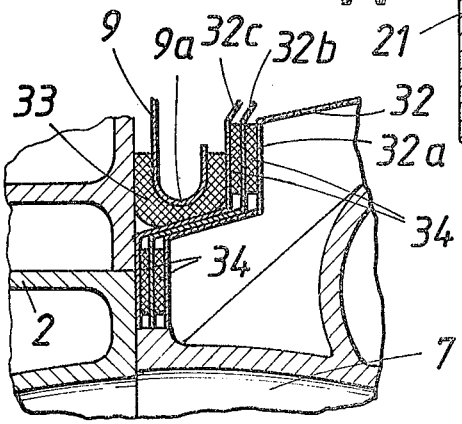
FIG. 5

RECIPROCATING INTERNAL COMBUSTION ENGINE AND SUPPORT ASSEMBLY

This invention relates to a reciprocating internal combustion engine comprising an engine block including cylinders, cylinder heads, a crankshaft, connecting rods, a camshaft, camshaft-driving gears, and intake and exhaust manifolds. The engine block is at least partly enclosed by a sheath connected to the engine block by sealing means which insulate against structure-borne sound.

In a reciprocating internal combustion engine disclosed in Opened German Application No. 26 12 182, the engine block is surrounded and carried by a frame, which is disposed on a level corresponding to about one-half the height of the cylinders and is supported by and connected to the top planar surface of a tublike sheath by means of an annular member which insulates against structure-borne sound. Said annular member constitutes also an oil seal between the sheath and the engine block. The upper portion of the engine block protrudes above the tublike sheath and may be shielded by a sound-insulating covering hood. To ensure a sound insulation, the annular member must be soft. But it must also transmit to the tublike sheath the forces which are due to the weight of the engine block and the torque of the engine so that the center line of the crankshaft will perform substantial radial excursions, which are not desirable. Resonances and additional excursions of the crankshaft may be caused by the unbalanced mass forces and torques of the cranks and connecting rods because the entire engine block suspended in the sheath can move like a pendulum. Finally, the axial positioning of the engine block, e.g., against any axial forces exerted by the clutch, is not reliably ensured. As a result, the crankshaft and the flywheel are movable in all directions so that the additional elements of the power train and particularly the clutch cannot be directly connected to the flywheel although this would be desirable, but a relatively complicated flexible coupling must be interposed and adds to the space required, to the structural expenditure and to the weight of the system which includes the engine.

In an improved design disclosed in German Patent Publication No. 28 01 431, the engine block is provided at both ends with sound-insulating supporting rings which are coaxial to the crankshaft and hold the engine block in the tublike sheath in a centered position and against an axial movement and only an oil seal is provided between the engine block and the top rim of the tublike sheath. In that case the engine block held in a centered position in the sheath cannot perform pendulumlike movements resulting in a dislocation of the center line of the crankshaft. But it has been found that in internal combustion having a relatively large displacement per cylinder the sound insulating rings must be deformable to such a large extent that the engine block will perform appreciable excursions relative to the sheath in a radial direction with respect to the crankshaft. Besides, the engine block can perform angular movements about the axis of the crankshaft and this renders the sealing between the sheath and the engine block rather difficult.

Austrian Pat. No. 308,475 discloses an internal combustion engine having a sheath comprising a first set of shell elements directly secured to the engine by means for insulating against structure-borne noise and through which conduits and other elements connected to the engine extend, and a second set of shell elements readily detachably secured to the shell elements of the first set by sound-insulating means and covering those portions of the engine and accessories which must be accessible for servicing. The shell elements of the second set comprise a top shell element, which is disposed over the covers for the rocker levers and carries the top shell element associated with the cylinder head, further comprise two lateral shell elements, which cover the side walls of the crankcase and any fuel injection pump, and a lower shell element, which is disposed under the oil sump and closes the lower shell element associated with the crankcase. That engine thus comprises a large number of shell elements which must be sealed against each other and against the engine proper so that a correspondingly large number of sealing and sound-insulating elements are required and the expenditure is further increased by the fact that an entire engine and a crankcase rather than an engine block must be sheathed. The brackets required to mount the engine are secured to the engine and to the crankcase without sound-insulating or covering means interposed so that they contribute to the transmission of sound to the outside and there is no satisfactory sound insulation in spite of the provision of the sheath.

It is an object of the invention to eliminate these disadvantages and to provide a reciprocating internal combustion engine which is of the kind described first hereinbefore and ensures a high sound insulation while requiring a low structural expenditure and precluding a radial movement of the crankshaft relative to the clutch or transmission.

This object is accomplished in accordance with the invention in that the engine block, the flywheel housing and, if desired, the transmission are rigidly interconnected in a manner known per se to constitute a unit. This unit is mounted by resilient means which insulate against structure-borne sound, the sheath defines an oil chamber which surrounds at least the engine block on all sides, and the sealing elements are annular and are provided at the ends of the engine block.

Because no forces are required to be transmitted by the sheath and the latter does not carry accessories, the sheath may be very light in weight and may consist, e.g., of sheet metal or plastic material. The sheath may be integral and may be formed with openings closed by covers. As the sheath is light in weight and is resiliently mounted on the engine block by the sealing elements, any vibrations of the sheath will have very small amplitudes so that satisfactory seals will be maintained for a very long time. As the sheath encloses the engine block on all sides, there is no need for a separate cover for the cylinder heads and fewer joints, which can be sealed only with difficulty, are required. The sealing rings provided at the ends of the engine block effect a seal within a minimum length and facilitate the mounting. As the engine block and the flywheel housing and, if desired, the transmission, are connected in a unit, there can be no radial movements of the crankshaft and the clutch or the transmission. That unit is elastically mounted by means which insulate against structure-borne noise so that an additional transmission of sound is minimized and an exertion of forces on the sheath is avoided.

At its end which is opposite to the flywheel, the unit may be supported by and connected to a crossbeam by elastic means which insulate against structure-borne sound, and accessories such as an electric generator, a water pump, a filter, and oil cooler and/or a compressor may be secured to the crossbeam so that the sheath need not carry such accessories and may have a very small wall thickness. Besides, the vibratable mass of the sheath is also reduced in that arrangement so that any vibration of the sheath relative to the engine block will have very small amplitudes.

Within the scope of the invention, a mounting plate which serves as a covering may be secured to the crossbeam and may be provided with a bearing which is coaxial to the crankshaft and a shaft for driving the accessories may be rotatably mounted in the bearing and connected to the crankshaft by a flexible coupling which insulates against structure-borne sound. As the shaft for driving the accessories is mounted in the mounting plate, which is secured to the crossbeam, there will be no relative movement between the accessories and their drive shaft. On the other hand the radial movements which are permitted between the crankshaft and the shaft for driving the accessories because the unit is resiliently mounted on the crossbeam will not be prevented by the flexible coupling and will have no detrimental effects owing to the coupling. Another advantage afforded by the mounting plate resides in that the plate constitutes a sound-insulating covering for the adjacent end of the crankshaft and the vibration damper which is usually provided. The fan shroud as well as the cooling air duct may be rigidly secured to the crossbeam and the fan may be driven from the shaft for driving the accessories so that radial relative movements between the fanwheel and the fan shroud will be avoided and a small clearance between the fanwheel and the fan shroud will be sufficient, as is desired for a high efficiency.

Additional means for supporting the unit and for insulating against structure-borne noise comprise rubber liners contained in lateral openings of the flywheel housing and supporting pins extending through the liners. The liners will prevent a transmission of sound from the flywheel housing to the supporting pins.

Adjacent to the exhaust manifold, the sheath has an elongate opening closed by a manifold housing enclosing the exhaust manifold, and an elastic sealing element which insulates against structure-borne noise is disposed between the sheath and the manifold housing. In this way the exhaust manifold is also sound-insulated.

The manifold housing is secured to the cylinder heads and a seal which insulates against structure-borne sound is interposed between the housing and the cylinder heads. The rim of the opening in the sheath conforms to the manifold housing and an elastic sealing element is interposed between the manifold housing and the rim. Adjacent to the opening, the manifold housing consists of laminations separated from each other by heat-resisting flat gaskets which insulate against structure-borne sound. The manifold housing is thus secured to the cylinder heads rather than to the thin sheath and nevertheless there are tight and sound-insulated joints between the sheath and the manifold housing and between the latter and each cylinder head. Because the wall of the manifold housing is laminated adjacent to the opening, the elastic seal provided on the sheath will be protected from an excessively high temperature rise. It will be understood that the laminated wall of the manifold housing might be replaced by an integral sealing member consisting of a suitable material.

The sound insulation can be further improved if the flywheel housing is enclosed by a separate sheath supported by and connected to the flywheel housing and the supporting pins by means which insulate against structure-borne noise. That separate sheath may also enclose the starter. Besides, a sheath for the transmission may be connected to the sheath for the flywheel housing. The starter may be secured to the flywheel housing in the conventional manner so that it will not be movable relative to the flywheel.

Figure 2:
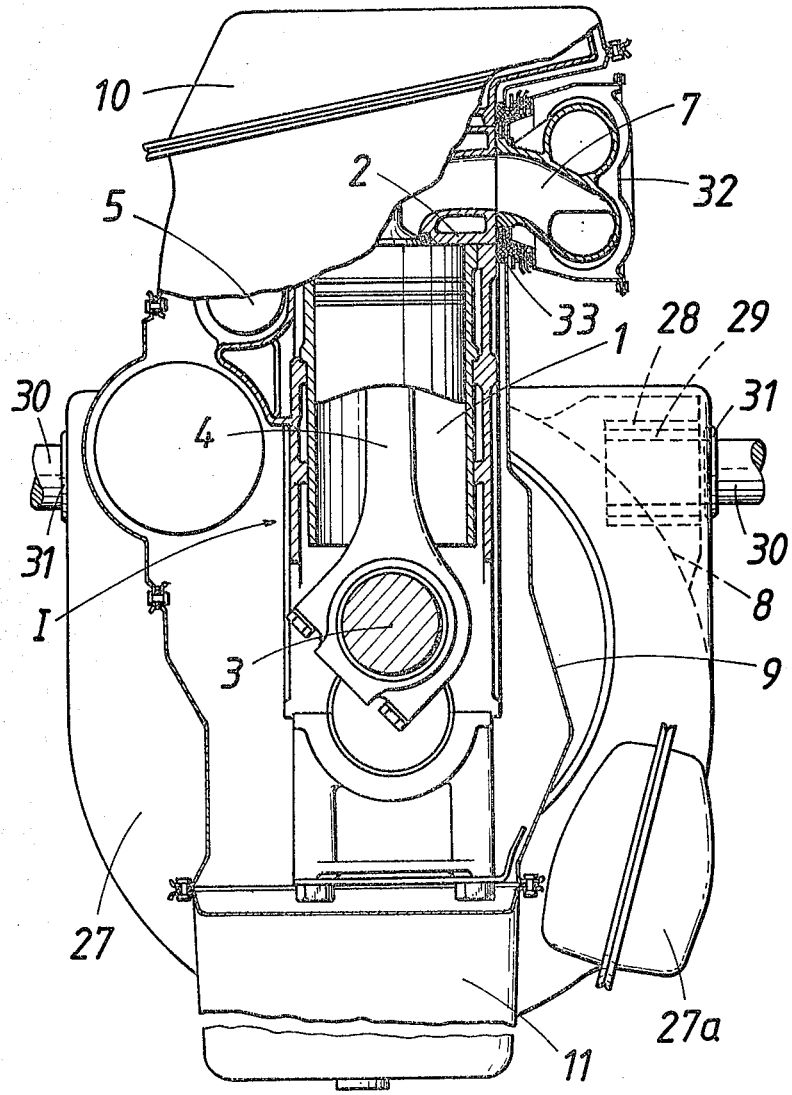
Figure 3:
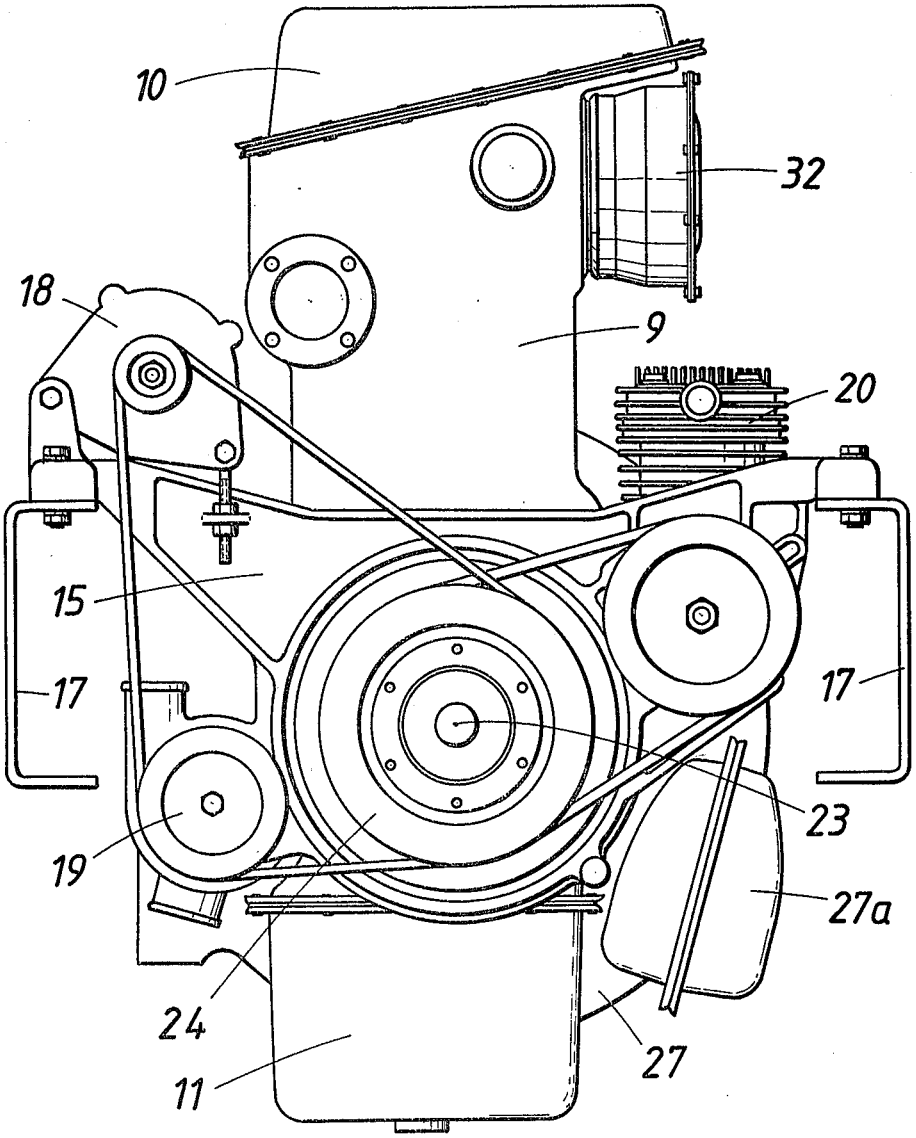

An embodiment of the invention is shown by way of example on the drawing, in which FIG. 1 is a vertical sectional view showing a multicylinder reciprocating internal combustion engine, FIG. 2 is a vertical transverse sectional view showing the engine of FIG. 1, FIG. 3 is an end view showing the engine of FIG. 1 with the fanwheel removed, FIG. 4 is an enlarged axial sectional view showing the means for driving the fanwheel and the accessories and FIG. 5 is an enlarged detail view showing the mounting of the housing which encloses the exhaust manifold.

An engine block I comprises cylinders 1, cylinder heads 2, a crankshaft 3, connecting rods 4 connected to the crankpins of the crankshaft, a camshaft 5, camshaft-driving gears 6, and intake and exhaust manifolds 7. The engine block I has no crankcase and is rigidly connected to a flywheel housing 8 to form a unit to which a transmission, not shown, may be rigidly connected. The engine block I is enclosed on all sides by a sheath 9, which has an opening provided with a removable cover 10 for access to the valve rocker levers and which comprises an oil sump 11 and defines an oil chamber. The sheath 9 is secured to the engine block I by sealing rings 12, 13, which insulate against structure-borne sound and are secured to the ends of the engine block I.

At that end which is remote from the flywheel 14, the unit consisting of engine block I and flywheel housing 8 is secured to a crossbeam 15 by a resilient ring 16, which insulates against structure-borne sound. The crossbeam 15 is carried by longitudinal members 17 of a chassis and carries accessories, such as an electric generator 18, a water pump 19 and a compressor 20, shown in FIG. 3. FIG. 4 shows that a mounting plate 21, which serves as a covering, is bolted to the crossbeam 15 and is provided with a bearing 22, which is coaxial to the crankshaft 3 and in which a shaft 23 is rotatably mounted. The shaft 23 carries a belt pulley 24 for driving the accessories 18, 19, 20 and is connected to the crankshaft 3 by a flexible coupling 25, which insulates against structure-borne sound. The flywheel housing 8 has a separate sheath 27, which is supported by and connected to the flywheel housing by means of rings 26 which insulate against structure-borne noise. The sheath 27 has a portion **27*a* which encloses the starter. As is shown in FIG. 2, the flywheel housing 8 has openings 28, which contain rubber liners 29 and receive pins 30 for supporting the unit consisting of engine block I and flywheel housing 8. The sheath 27 for the flywheel housing 8 is supported by and connected to the pins 30 by means of rings 31** which insulate against structure-borne sound.

Adjacent to the exhaust manifold 7 the sheath 9 has an elongate opening closed by a manifold housing 32, which encloses the exhaust manifold 7. As is apparent from FIG. 5, the rim **9*a* of the opening in the sheath 9 conforms to the manifold housing 32 with an elastic sealing element 33 interposed. Adjacent to the rim 9***a*, the housing 32 has laminations 32*a*, 32*b*, 32*c*, separated by heat-resisting flat gaskets 34, which insulate against structure-borne sound.

What is claimed is:

1. A reciprocating internal combustion engine comprising the combination of (a) an engine block including cylinders, at least one cylinder head, a crankshaft, connecting rods connected to the crankshaft, a camshaft, camshaft driving gears operatively connecting the crankshaft and camshaft, and intake and exhaust manifolds communicating with the interior of the cylinders;

(b) a flywheel non-rotatably connected to the crankshaft at a first end of the engine block;

(c) a housing accommodating the flywheel and rigidly connected to the first end of the engine block to form a unit therewith;

(d) a multi-part sheath connected together and enclosing at least part of the engine block, the sheath having a first end at the first end of the engine block and a second end at the second end of the engine block, and the sheath defining a common oil chamber around the engine block;

(e) respective sealing rings securing the first and second ends of the sheath to respective ends of the engine block each continuously encircling the crankshaft and insulating against structure-borne sound;

(f) a crossbeam disposed at the second end of the engine block, elastic means supporting the flywheel housing and engine block unit on the crossbeam and insulating against structure-borne sound, and driven engine accessories carried by the crossbeam; and (g) laterally disposed, rubber lined bushings in said flywheel housing having support pins extending thereinto for supporting said flywheel housing and engine block unit.

2. The reciprocating internal combustion engine of claim 1, further comprising a mounting plate secured to the crossbeam and serving as a cover, the mounting plate comprising a bearing coaxial with the crankshaft, a drive shaft for the accessories rotatably mounted in the bearing, and a flexible coupling operatively connecting the drive shaft and crankshaft, the flexible coupling insulating against structure-borne sound.

3. The reciprocating internal combustion engine of claim 1, further comprising a separate sheath for the flywheel housing and means supporting the separate sheath on the flywheel housing and insulating against structure-borne sound, the flywheel housing sheath including a portion enclosing a starter.

4. The reciprocating internal combustion engine of claim 1, wherein the sheath defines an elongate opening receiving the exhaust manifold, the manifold extending through the opening outside the sheath, and further comprising a housing enclosing the exhaust manifold outside the sheath, and an elastic sealing element interposed between the opening and the housing for sealing the opening, the sealing element insulating against structure-borne sound.

5. The reciprocating internal combustion engine of claim 4, wherein the sheath opening has a rim and the elastic sealing element is conformingly interposed between the rim and the manifold housing, the housing having laminations separated by heat-resistant flat gaskets insulating against structure-borne sound at the sheath opening.

* * * * *